US005538392A

United States Patent [19]

Leifeld et al.

[11] Patent Number: 5,538,392

[45] Date of Patent: *Jul. 23, 1996

[54] METHOD AND APPARATUS FOR PLACING FIBER BALES IN SERIES FOR A FIBER TUFT DETACHING OPERATION

[75] Inventors: Ferdinand Leifeld, Kempen; Josef Temburg, Jüchen, both of Germany

[73] Assignee: Trützschler GmbH & Co. KG, Möchengladbach, Germany

[ * ] Notice: The term of this patent shall not extend beyond the expiration date of Pat. No. 5,328,016.

[21] Appl. No.: 194,146

[22] Filed: Feb. 9, 1994

Related U.S. Application Data

[63] Continuation-in-part of Ser. No. 120,848, Sep. 15, 1993, Pat. No. 5,328,016, which is a continuation of Ser. No. 936,702, Aug. 28, 1992, abandoned.

[30] Foreign Application Priority Data

| | | | |
|---|---|---|---|
| Aug. 28, 1991 | [DE] | Germany | 41 28 471.2 |
| May 6, 1992 | [DE] | Germany | 42 14 934.7 |
| Feb. 9, 1993 | [DE] | Germany | 43 03 685.6 |

[51] Int. Cl.[6] ..... B65G 47/52

[52] U.S. Cl. ..... 414/798.2; 198/345.1; 414/786; 414/798.5; 414/798.9

[58] Field of Search ..... 198/345.1, 434, 198/418.9, 461; 414/411, 412, 786, 798.2, 798.5, 798.7, 798.9; 19/80 R

[56] References Cited

U.S. PATENT DOCUMENTS

| | | | |
|---|---|---|---|
| 3,236,162 | 2/1966 | Reist | 414/798.2 |
| 3,458,904 | 8/1969 | Kotter et al. | 19/80 R |
| 3,884,345 | 5/1975 | Tokuno | 414/798.2 |
| 4,554,708 | 11/1985 | Leifeld et al. . | |
| 4,718,534 | 1/1988 | Harper | 198/401 |
| 5,090,864 | 2/1992 | Leifeld | 414/412 |
| 5,179,763 | 1/1993 | Zander et al. | 19/80 R |

FOREIGN PATENT DOCUMENTS

| | | | |
|---|---|---|---|
| 63-92538 | 4/1988 | Japan | 414/798.9 |
| 1260081 | 9/1986 | U.S.S.R. | 414/798.9 |
| 2074621 | 11/1981 | United Kingdom . | |
| 2237823 | 5/1991 | United Kingdom . | |
| 91/05092 | 4/1991 | WIPO . | |
| 91/05091 | 4/1991 | WIPO . | |

OTHER PUBLICATIONS

Copies Provided During Prosecution of Parent application Ser. No. 07/936,702.

*Primary Examiner*—Karen B. Merritt
*Assistant Examiner*—Janice L. Krizek
*Attorney, Agent, or Firm*—Spencer & Frank

[57] ABSTRACT

An apparatus for placing fiber bales end-to-end in a series includes a bale emplacement for supporting thereon the bales forming the series; a bale depositing device for setting a fiber bale at an inclination on the bale emplacement to build the series; and a bale holding device situated at a location along the bale emplacement. The bale holding device has a bale engaging member movable into engagement with a vertical lateral face of a bale situated at the location for stabilizing the bale; and a power device for moving the bale engaging member into or out of engagement with the bale situated at the location.

21 Claims, 7 Drawing Sheets

METHOD AND APPARATUS FOR PLACING FIBER BALES IN SERIES FOR A FIBER TUFT DETACHING OPERATION

This application is a continuation-in-part of application Serial No. 08/120,848, filed Sep. 15, 1993, now U.S. Pat. No. 5,328,016 issued Jul. 12, 1994 which is a continuation of application Ser. No. 07/936,702 filed Aug. 28, 1992, now abandoned.

This application claims the priority of German Applications P 41 28 471.2 filed Aug. 28, 1991, P 42 14 934.7 filed May 6, 1992 and P 43 03 685.6 filed Feb. 9, 1993, which are incorporated herein by reference.

BACKGROUND OF THE INVENTION

This invention relates to a method and an apparatus for placing in readiness fiber bales, such as cotton, chemical fiber or other bales in a series, in preparation for a fiber tuft removal process performed by a travelling bale opener. One or several successive initial fiber bales of the series are positioned at a slight inclination in one direction whereas the additional bales of the series are positioned either in a vertical orientation or at an inclination which is opposite to the inclination of the initial fiber bale or fiber bales. Prior to positioning the additional fiber bales, the initial fiber bale or fiber bales are held (stabilized) by a bale holding and/or supporting device as described in the parent application Serial No. 07/936,702. After the additional fiber bales have been deposited and, as they lean against an adjoining initial fiber bale, they themselves are capable of stabilizing the initial fiber bales. Therefore, the holding and/or supporting device is moved away from the initial fiber bale or fiber bales, that is, as the bale resupplying of the bale series continues, the initial bales no longer need the bale holding and/or supporting device for stabilization.

SUMMARY OF THE INVENTION

The principal purpose of the parent application Ser. No. 07/936,702 was to ensure in a simple and secure manner the support of the initial fiber bale or fiber bales and an automatic readying of a fiber bale series for a detaching operation by a bale opener. The object of this invention is to present additional embodiments for achieving the purpose stated.

This object and others to become apparent as the specification progresses, are accomplished by the invention, according to which, briefly stated, the apparatus for placing fiber bales end-to-end in a series includes a bale emplacement for supporting thereon the bales forming the series; a bale depositing device for setting a fiber bale at an inclination on the bale emplacement to build the series; and a bale holding device situated at a location along the bale emplacement. The bale holding device has a bale engaging member movable into engagement with a vertical lateral face of a bale situated at the location for stabilizing the bale; and a power device for moving the bale engaging member into or out of engagement with the bale situated at the location.

Normally the fiber bales are prepared by repeatedly filling and compressing fiber material in a press form or mold. In this manner a fiber bale of layered consistency is obtained which, after releasing the holding straps (bale ties), expands upwardly to a greater or lesser extent. The lateral dimensions of the fiber bale remain essentially unchanged so that particularly the transverse sides of the bales have an increased strength. By a horizontally directed engagement by the holding or supporting devices the latter contact the bales at their transverse and/or longitudinal vertical sides whereby the bale may be securely supported (stabilized).

In the present context distinction is to be made between "holding" and "supporting" the fiber bale. By "holding" the fiber bale there is meant an engagement by the holding device of those vertical sides of the bales which extend parallel to the bale transport track (bale emplacement), that is, parallel to the bale series. These sides will also be referred to as the vertical lateral bale faces. In contrast, a "support" of the fiber bale means in general an engagement by the stabilizing device of those vertical bale sides which extend transversely to the bale conveying track and is thus effective in a direction opposite the conveying direction of the fiber bale. These bale sides will also be referred to as the transverse bale faces.

In a preferred embodiment of the method according to the invention the holding device is arranged parallel to the initial fiber bales standing on the transport track and the holding is effected by exerting a pressure on a vertical lateral face of the initial fiber bale. Preferably, the holding is carried out by a bilateral clamping of the initial fiber bale. The supporting is effected preferably by pressing the initial fiber bale against its direction of advance. The fiber bales are preferably conveyed along a holding element extending parallel to the conveying direction.

Preferably, a bale transfer carriage is moved in a loading position in alignment with the transport track, the supporting wall of the carriage is pressed against a transverse face of the initial fiber bale, the holding devices (spike boards) on opposite sides of the bales are withdrawn from the initial fiber bale, the initial fiber bale is, as the supporting wall moves, displaced onto the transfer carriage from the transport track and the spike boards are pressed against the subsequent fiber bale on the transport track. With this embodiment of the invention it is feasible to take a single fiber bale from the transport track and move the same to another position, for example, to a conveyor belt which serves a bale opener, such as a BLENDOMAT BDT 020 model manufactured by Trützschler GmbH & Co. KG, M önchengladbach, Germany.

Preferably prior to displacing the transfer carriage, its support wall, as the initial bale lies against it, is moved beyond the vertical until a negative angle is reached. A negative angle is meant here to be an acute angle to the vertical, opening in a direction opposite the conveying direction of the conveyor belt serving the bale opener. Expediently, the first two to six fiber bales are transferred under such a negative angle to a conveyor belt. After the transfer carriage, transporting a fiber bale, arrives into alignment with the conveyor belt, the subsequent fiber bales are, by pivotal motion of the support wall of the transfer carriage, swung through the vertical to assume an inclination at a positive angle to thus lean against and be supported by the negatively inclined bales on the conveyor belt. Preferably, in each instance the last fiber bale transferred onto the conveyor belt is, until reaching the pressing force balance between the bales set with a negative angle and those set with a positive angle, held by a holding device. The initiation of the bale feed, the stoppage of the transport track, the transfer carriage, the transfer belt mounted on the transfer carriage and the motion of the supporting or holding devices are effected by means of at least one sensor.

For performing the method according to the invention, there is utilized an apparatus for readying fiber bales in a series along a fiber bale opener, wherein the apparatus deposits the initial fiber bales of the series on a transport track with a slight inclination in one direction and the additional fiber bales in a vertical orientation or at an inclination which is opposite to the inclination of the initial fiber bale. A holding device is arranged laterally of the bale series and is movable horizontally into or out of engagement with a lateral vertical face of an inclined fiber bale. When in engagement, the holding device firmly stabilizes the fiber bale in its inclined position. Further, a transfer vehicle is provided which is movable on rails between a bale transport track and a conveyor belt serving a bale opener. The transfer vehicle has a transfer belt on which a fiber bale may be positioned and a pivotal supporting wall which is mounted on the transfer belt and which is adapted to support an end face of an inclined fiber bale situated on the transfer belt.

The apparatus according to the invention has the following additional advantageous features:

The transport belt is arranged at a settable angle.

The supporting wall may be set on each side of the vertical at an angle which is preferably between 10° and 20°.

The holding device has at least one jointed cantilever carrying a pressing plate provided with spikes or needles. The cantilever is operatively connected with power cylinders which are coupled with the pressure plate.

DESCRIPTION OF THE PREFERRED EMBODIMENTS

Figure 1:
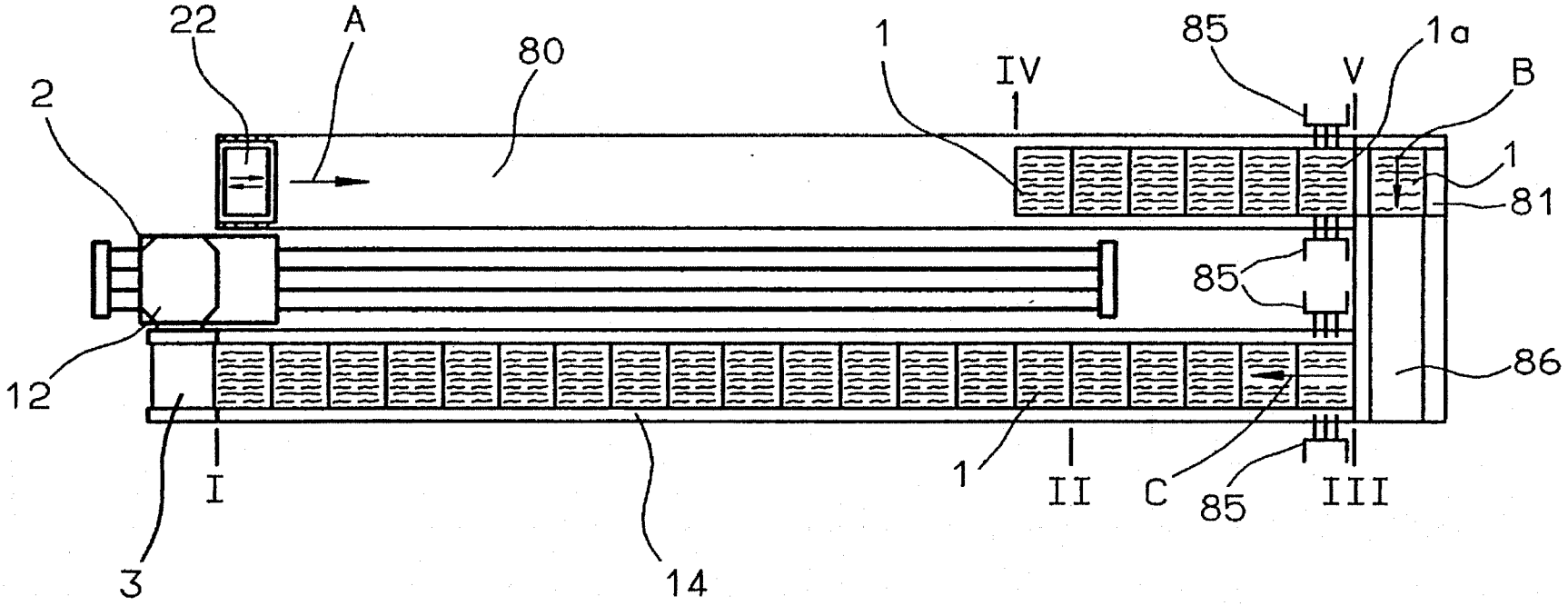
FIG. 1 is a schematic top plan view of a preferred embodiment of the invention.

Turning to FIG. 1, a bale charging carriage 22 is situated at the beginning of a bale transport track (bale emplacement) 80 which is constituted by an upper run of a conveyor belt and which moves in the direction of the arrow A. The carriage 22 is ready to receive a fiber bale 1 and transport it to the proximal end of a bale series accumulated in an end-to-end relationship on the transport track 80. The initial fiber bale la, that is, the fiber bale which is at the remote end of the bale series as viewed from the beginning of the transport track 80 is, at its lateral vertical faces held by a holding device (spiked boards) 85 penetrating into opposite bale faces. A transfer carriage 81 which, as depicted in FIG. 1, is situated in a loading position in alignment with the transport track 80, has already received one fiber bale 1 therefrom and is ready to travel with the fiber bale 1 on rails 86 to a bale transfer position at the intake end of a conveyor belt (bale emplacement) 14. Since the conveyor belt 14 is fully occupied by fiber bales, the holding device (spiked boards) 85 at the intake end of the conveyor belt 14 is not in a holding relationship with a fiber bale because each fiber bale is stabilized by the adjoining fiber bales.

Figure 2:
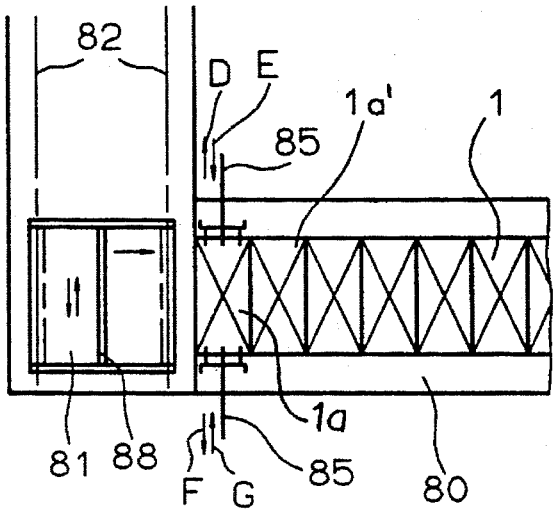
FIGS. 2, 3 and 4 are schematic top plan views illustrating further details of the construction shown in FIG. 1.
Figure 3:
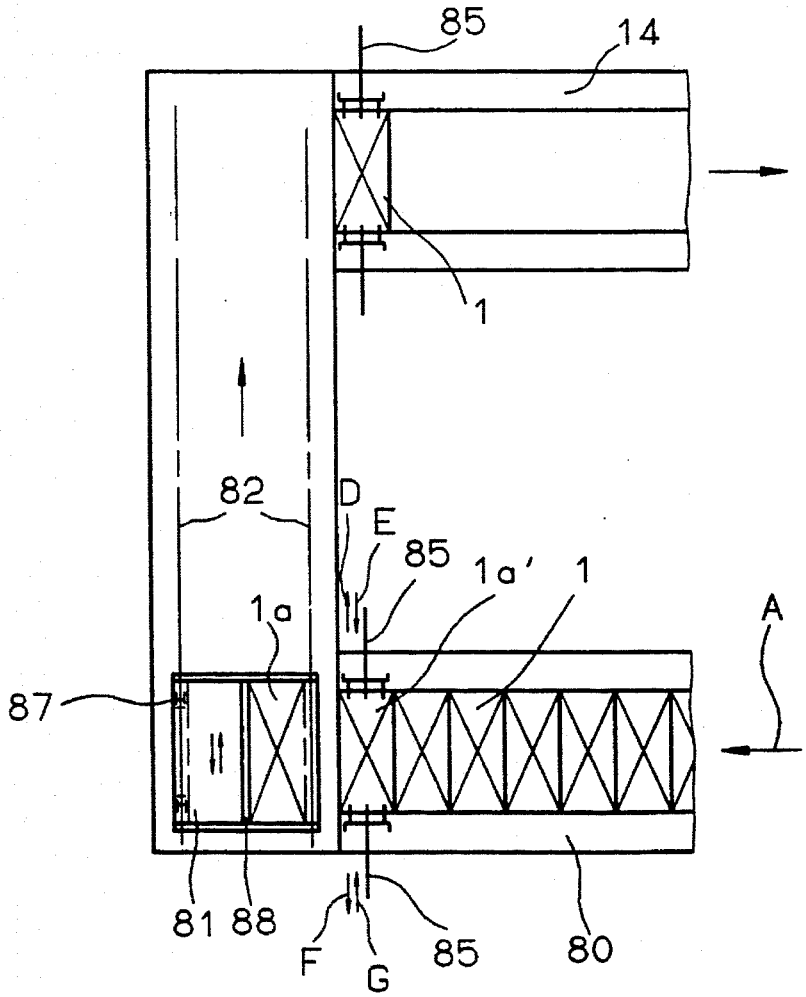
Figure 4:
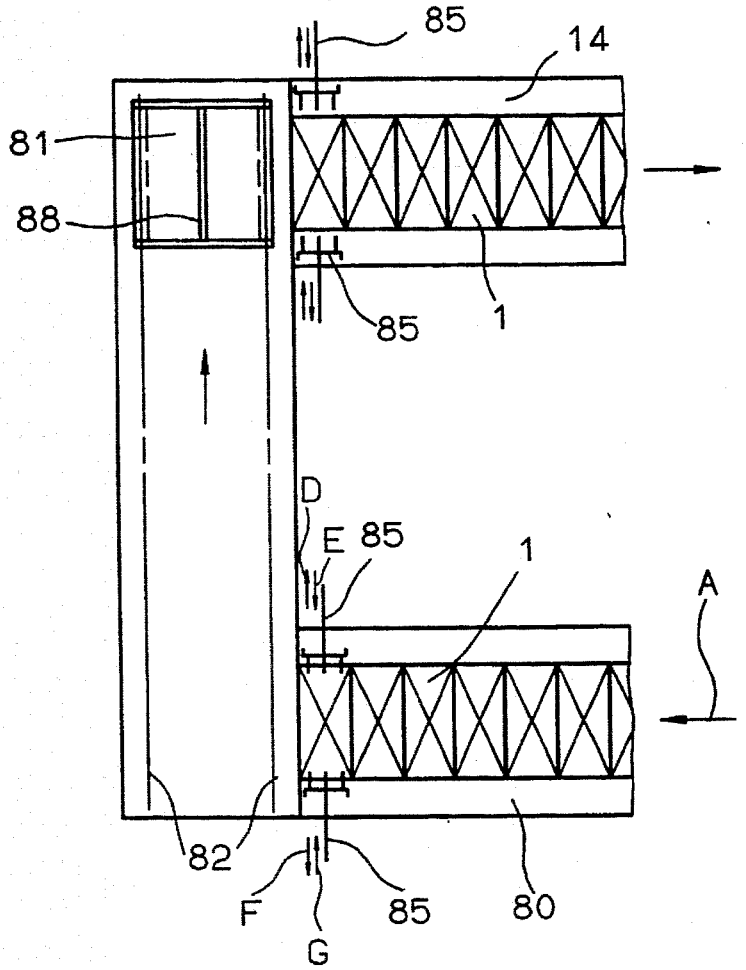

FIGS. 2, 3 and 4 illustrate the discharge end of the transport track 80, the inlet end of the conveyor belt 14 as well as the transfer carriage 81 which runs on rails 82 back-and-forth between the discharge end of the transport track 80 and the inlet end of the conveyor belt 14. In FIG. 2 the initial fiber bale 1*a* on the transport track 80 is held by the spiked boards 85. The supporting wall 88 of the transfer carriage 81 moves from its position shown in FIG. 2 towards the initial fiber bale 1*a* and supports the latter. Thereupon, the holding device (spiked boards) 85 is moved away from the fiber bale 1*a* into a disengaged position. Thereafter, the transport track 80 as well as a transfer belt 89 mounted on the transfer carriage 81 is cycled, as a result of which the bale 1*a* is, together with the support wall 88, moved in the direction of the arrow A onto the transfer carriage 81. The second fiber bale 1*a*' thus reaches the end position on the bale transport track 80. The feed of the transport track 80 is then stopped and the spiked boards 85 are moved into engagement with the lateral vertical faces of the fiber bale 1*a*'. The fiber bale 1*a* on the transfer carriage 81 is moved by the transfer belt 89 in the direction of the arrow A until it is disengaged from the fiber bale 1*a*'. The transfer carriage 81 may now be moved on the rails 82 into its second position, that is, into a discharging position in alignment with the conveyor belt 14, at the intake end thereof.

As seen in FIG. 3, on the conveyor belt 14 a single fiber bale 1 is situated; that is, the charging of the conveyor belt 14 with fiber bales has just started. This fiber bale 1 is being held (stabilized) in its position by spiked boards 85. As will be discussed later, the fiber bale 1 is inclined in the direction of the transfer carriage 81.

FIG. 4 illustrates the transfer carriage 81 in its end position in front of the intake end of the conveyor belt 14 which is fully charged with fiber bales 1. Since the fiber bales 1 lean against one another, a holding of any fiber bale is no longer necessary. For this reason the spiked boards 85 are withdrawn; that is, they are in a non-engaging position.

Figure 5:
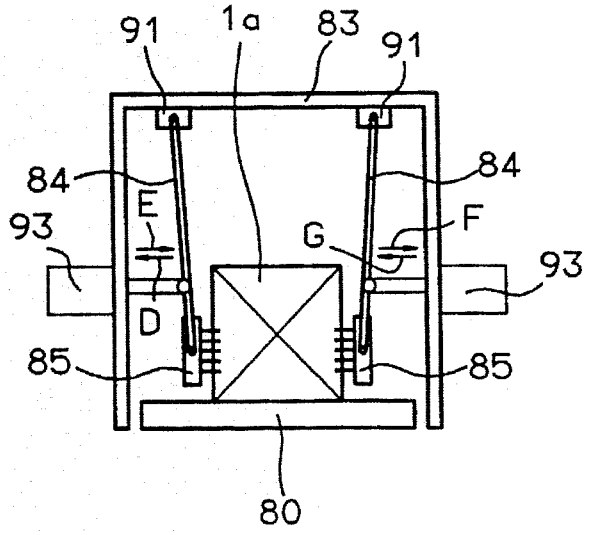
FIG. 5 is a schematic front elevational view of a holding device according to the invention.

FIG. 5 illustrates an embodiment of the bale holding device. The spiked boards 85 are articulated to respective levers 84 each movable towards (arrows E and G) or away from (arrows D and F) the fiber bale situated on the bale transport track 80. At its end remote from the spiked board 85 the respective lever 84 is pivotally supported by a sliding bearing 91 mounted on the horizontal beam of a frame 83.

Figure 5A:
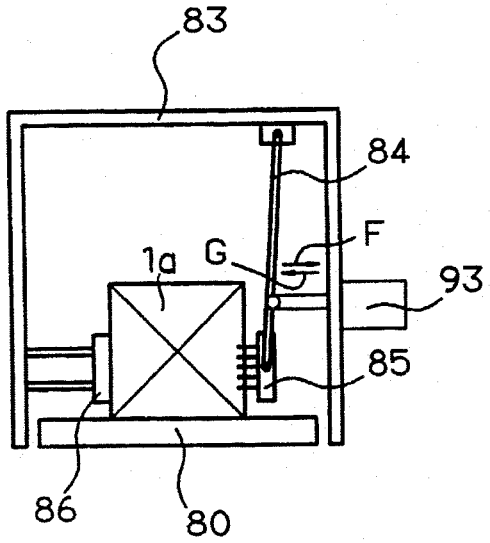
FIG. 5*a* is a schematic front elevational view of a variant of the holding device shown in FIG. 5.

FIG. 5*a* shows an alternative to the construction depicted in FIG. 5. In the FIG. 5*a* embodiment, one of the spike boards 85 shown in FIG. 5 is replaced by a glide rail 86 against which the initial fiber bale 1*a* is pressed by the spike board 85 acting on the other side of the initial fiber bale 1*a*.

Figure 6A:
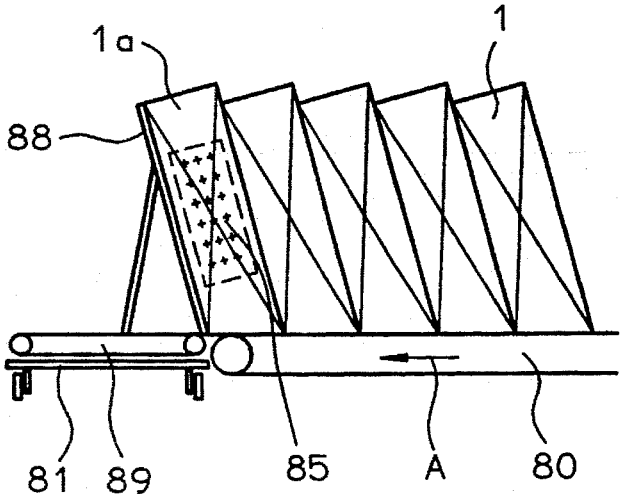
FIGS. 6*a* and 6*b* are schematic side elevational views of a bale separating arrangement showing two phases of operation.
Figure 6B:
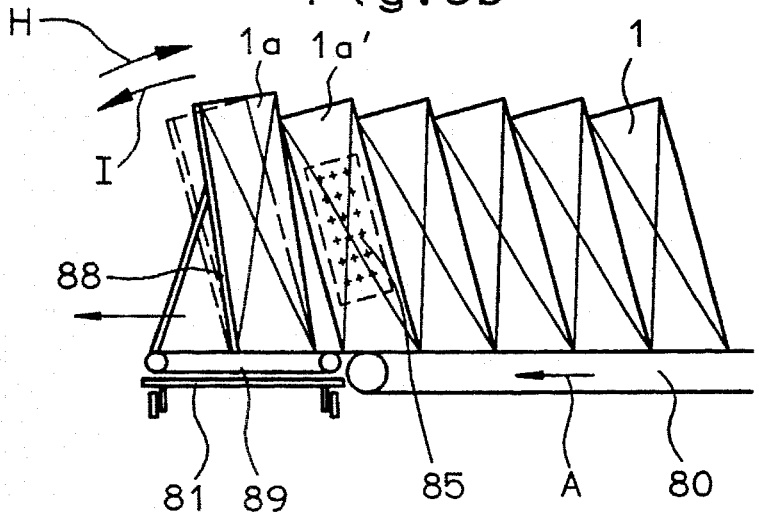

FIGS. 6*a* and 6*b* illustrate the process of separating the fiber bales 1 from one another at the discharge end of the transport track 80. On the transport track 80 a plurality of fiber bales 1 are conveyed in the direction A while they stand at an inclination. The leading fiber bale 1*a* is held in its inclined position by the spiked boards 85 which engage those vertical faces of the fiber bale 1*a* which extend parallel to the conveying direction A. The transfer carriage 81 is shown in its loading position in alignment with the transport track 80. The support wall 88 of the transfer carriage 81 is situated at an end of the transfer carriage 81 and engages face-to-face the initial fiber bale 1*a*. Under these conditions the spiked boards 85 may be moved away from the fiber bale 1*a* so that the latter becomes laterally free and is held only by the support wall 88 of the transfer carriage 81. After withdrawal of the spiked boards 85 the feed motion of the transfer belt 89 is initiated simultaneously with the feed motion of the transport track 80, whereby a one-step bale transport occurs that corresponds to the length of one fiber bale, as viewed in the feed direction A. As a result, the previously second fiber bale 1 appears as the new initial fiber bale 1*a*' in the end position of the transport track 80. The spiked boards 85 are again moved into their operational position in which they press against the new initial fiber bale 1*a*'. The transfer belt 89 further moves the initial fiber bale 1*a* until a free space appears between the fiber bales 1*a* and 1*a*'. Thereafter, the inclination of the bale 1*a*, that is, the angle α which is the angle of inclination of the support wall 88 to the horizontal is set for the conveyance by the transfer carriage 81 on the rails 82.

Figure 7A:
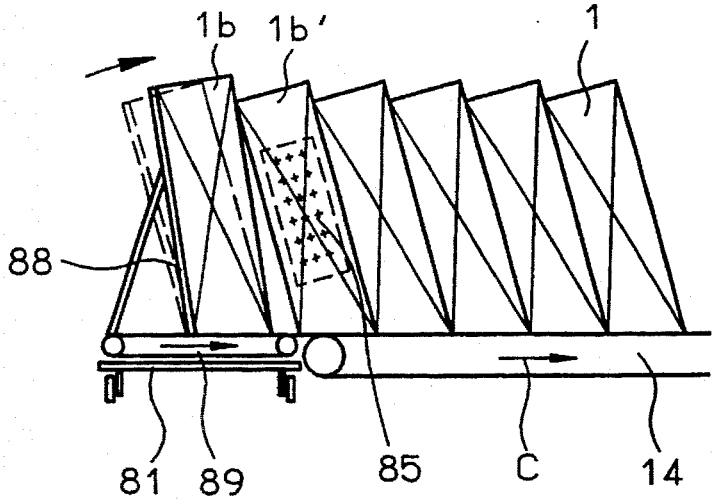
FIGS. 7*a*, 7*b* and 7*c* are schematic side elevational views illustrating further details of the construction of FIG. 1 in three operational phases.
Figure 7B:
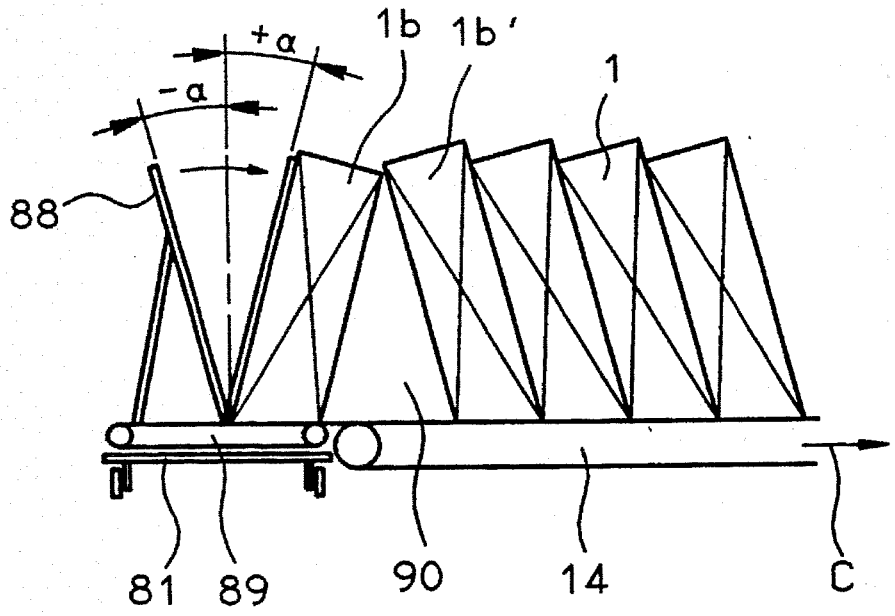
Figure 7C:
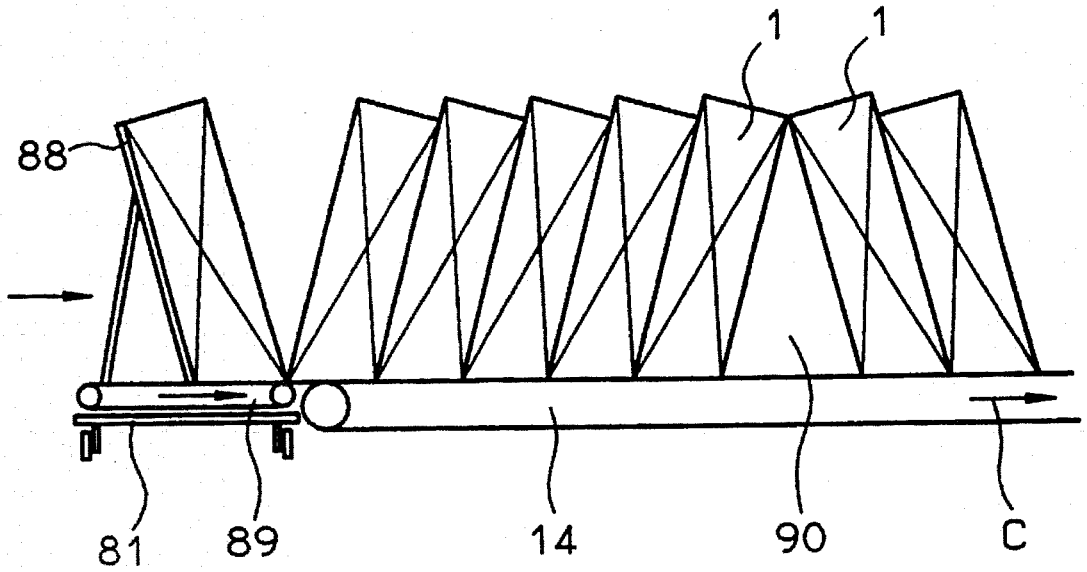

FIGS. 7*a*, 7*b* and 7*c* illustrate the setting of the fiber bales 1 onto the conveyor belt 14 from the transfer carriage 81. After the transfer carriage 81 has been moved into its end position in alignment with the conveyor belt 14 which at that time is free of fiber bales, while maintaining the negative angle α of approximately 15°, the first fiber bale is, by means of the transfer belt 89, while supported by the rear wall 88, moved onto the conveyor belt 14. The conveyor belt, in turn, moves through one cycle, that is, through a distance which corresponds to one bale length, measured parallel to the bale feed. When the support wall 88 has reached the conveyor belt 14, the latter, as well as the transfer belt 89 is stopped and the spiked boards 85 of the holding device are brought into penetrating engagement with the first fiber bale now designated at 1*b* to maintain the latter in position. In a similar manner the next one to five further bales 1 are set onto the conveyor belt 14; in each instance the last-set bale 1*b* is held by the spiked boards 85 of the holding device. After having set up generally three to five bales 1 with the negative angle α, the next supplied fiber bale 1, as soon as the transfer carriage 81 has reached its end position in alignment with the conveyor belt 14, is, by virtue of moving the conveyor belt 14, leaned with a positive angle α against the already set fiber bales 1 as shown in FIG. 7*b*. Then the support wall 88 is so inclined that the angle α becomes positive—as the conveyor belt 14 continues to move—and upon reaching the end position, that is, when the angle α has reached a positive value of approximately 15° the transfer belt 89 is started and the fiber bale 1*b* is deposited thereon as the conveyor belt 14 runs. Between the fiber bale 1*b*' having a negative inclination and the fiber bale 1*b* there is thus obtained a wedge-shaped space 90 which is shown in FIG. 7*b* to an exaggerated extent and which, in practice, is at least in its upper range significantly smaller because of the deformation of the adjoining fiber bales.

After the fiber bale 1*b* has assumed its position at the beginning of the conveyor belt 14, it is, similarly to the previous bale 1*b*', held firmly in its position by the spike boards 85. The support wall 88 of the transfer carriage 81 moves backwardly and the subsequent transfer step may take place in which the momentarily last fiber bale 1*b* set on the conveyor belt 14 is held by the spike boards 85 until there occurs a pressure equalization between the bales of positive angle α and the bales of negative angle α.

The transfer process is repeated until such time with periodical clamping of the last-delivered bale 1 of positive inclination by the spike boards 85 until a pressure equalization has taken place, that is, approximately the same number of bales 1 with negative and positive inclination are situated on the conveyor belt 14. At that point the positional stability of the fiber bales 1 is achieved and a holding of the fiber bales by the spike boards 85 is no longer necessary as the fiber bale supply further progresses.

Reverting to FIG. 1, the conveyor belt 14 includes the working zone situated between positions I and II in which detaching of the fiber bales by the fiber bale opener 2 takes place and further, the conveyor belt 14 also includes the first standby bale zone situated between locations II and III. On the transport track 80 there is situated the second standby bale zone between the locations IV and V. The arrows A, B and C indicate the direction of motion of the transport track 80, the transfer carriage 81, and the conveyor belt 14, respectively, while arrows D, E, F and G indicate the direction of motion of the spike boards 85 and arrows H and I indicate the direction of pivotal motion of the support wall 88.

Figure 8:
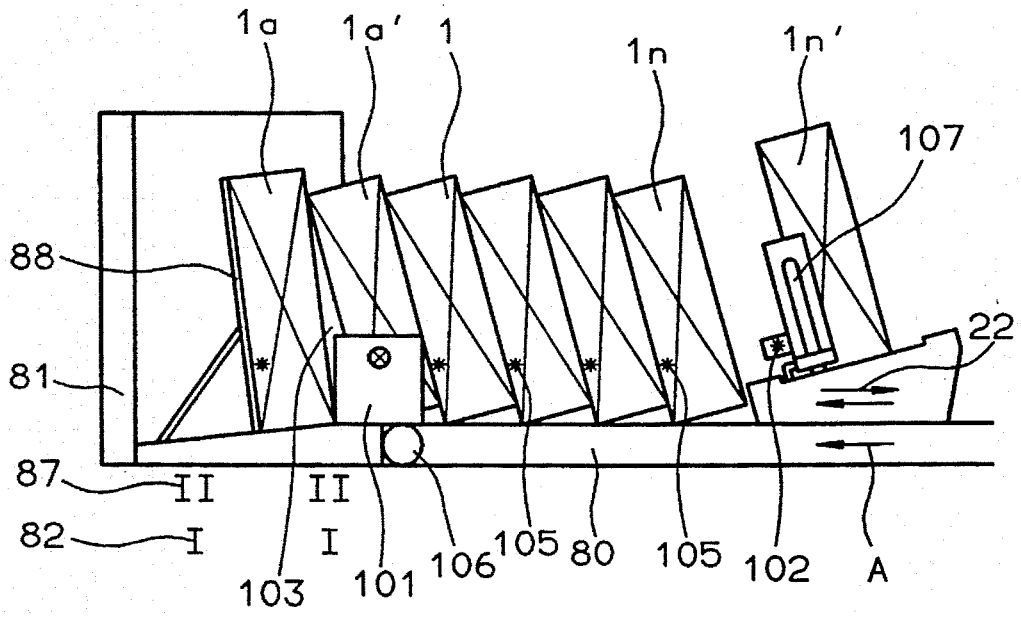
FIG. 8 is a schematic side elevational view of the bale transport track of the construction shown in FIG. 1, including a bale transporting carriage, a marking device and sensor.

FIG. 8 depicts the condition where the transporting carriage has moved from the intake-end of the bale transport track 80 (FIG. 1) with a bale 1*n*' to the trailing bale 1*n* of the bale series standing on the transport track 80. The bale transport carriage 22 has a marking device 102 which provides the bale 1*n*' situated on the carriage 22 with a mark 105 on a vertical lateral face at a predetermined distance from a leading bale edge as viewed in the direction of bale advance on the transport track 80 (arrow A). Since each fiber bale 1*n*' has, on the bale transport carriage 22, always the same orientation, that is, it engages the braces 107, the marking 105 is independent from the dimensions of the bale and is therefore always placed at the same location of each fiber bale.

The marking may be performed in any desired manner. It may be a label affixed to the bale 1*n*' by means of a needle. Preferably, however, the marking is a color patch of contrasting color applied, for example, by a spraying device.

In the zone of the support roller 106 of the transport track 80 a sensor 101 is arranged. As soon as the marking 105 of a bale has reached the sensor 101, the latter generates a signal which triggers different switching processes. The bale 1*a*' has, when its marking reaches the sensor 101, reached its end position on the transport track 80. The signal generated by the sensor 101 therefore initiates the feed motion of the transport track 80 in the direction A. At the same time, the bale 1*a*' is fixed in its position, that is, as described previously, is clamped at its sides by a holding device, not shown in FIG. 8. The previous bale 1*a* which lies against the support wall 88 of the transfer carriage 81 and is moved by means of the transfer belt 89 together with the support wall 88 is, by changing the supporting angle, brought into a position which is closer to the vertical, whereby in the lower zone between the initial bales 1*a* and 1*a*' a wedge-shaped gap 103 is formed. The transfer belt 89 continues to move with the support wall 88 until the end position thereof, so that the initial fiber bale 1*a* is released, that is, it no longer contacts the initial fiber bale 1*a*'.

Figure 9:
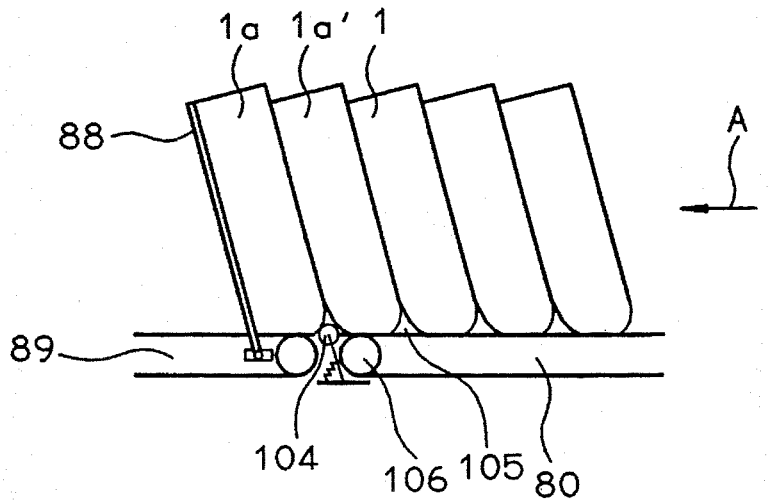
FIG. 9 is a schematic side elevational view of a variant of the construction shown in FIG. 8, showing a sensor roller.

FIG. 9 shows an alternative solution to that illustrated in FIG. 8. In the FIG. 9 arrangement no marking is required. In the zone between the transport track 80 and the transfer belt 89 a sensor roller 104 is arranged which, upon transfer of the initial fiber bale 1*a* onto the transfer belt 89 of the transfer carriage 81, rolls along the bottom surface of the initial fiber bale 1*a*. When the sensor roller 104 senses the gap 103 between the initial fiber bale 1*a* and the initial fiber bale 1*a*' a signal is generated which, as described previously, is utilized for stopping the transport track 80 and to fix the initial fiber bale 1*a*' in its position.

Figure 10:
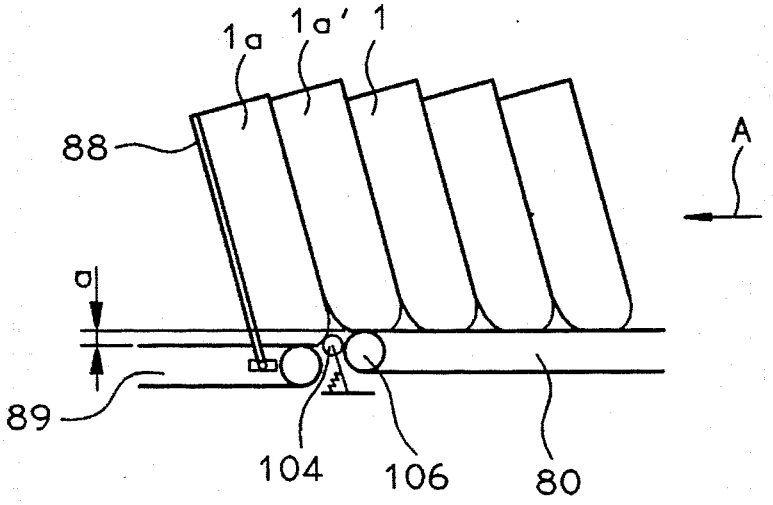
FIG. 10 is a schematic side elevational view similar to FIG. 9, showing a height staggered bale transfer belt.

An alternative solution to the arrangement shown in FIG. 9 is illustrated in FIG. 10. Since the gaps 103 at the foot zone of the adjoining fiber bales may be very small, at least theoretically there is a possibility that the sensor roller 104 does not recognize the gap 103. If, however, the upper run of the transfer belt 89 is situated lower than the upper run of the transport track 80, then upon transfer of a fiber bale la, the latter, guided by the support wall 88 and the following initial bale 1*a*' slides downwardly onto the transfer belt 89. Such a drop of the bottom bale surface is securely sensed by the sensor roller 104 which thus can emit a signal.

Figure 11:
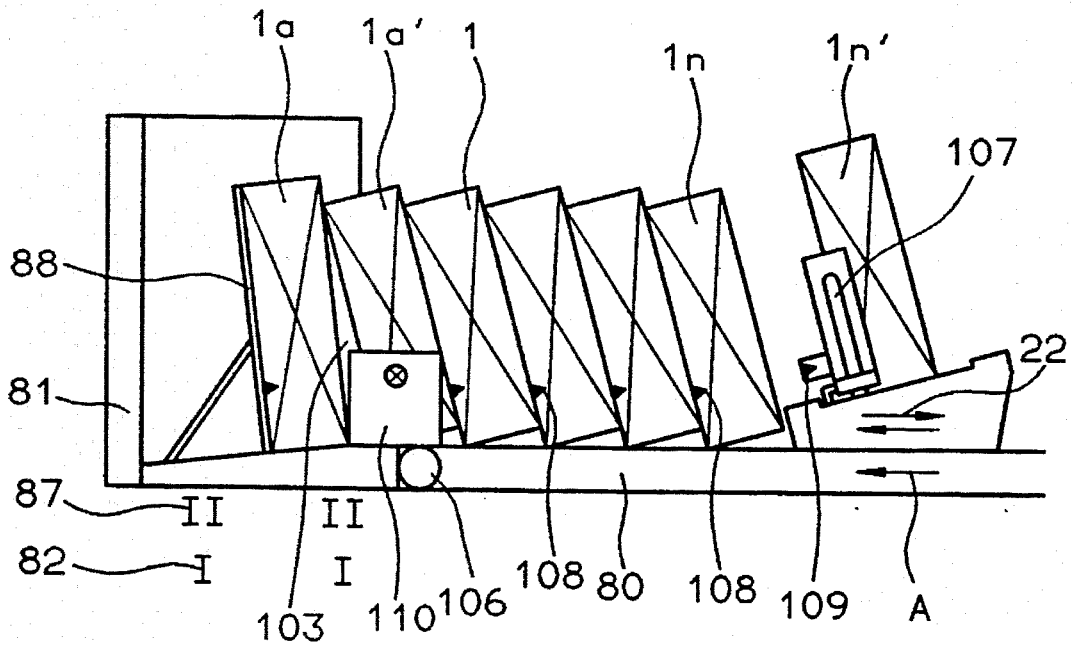
FIGS. 11 and 12 are schematic side elevational views of a bale transport track showing two embodiments of a marker inserting and marker sensing device.

FIG. 11 illustrates a further embodiment of a mechanical solution for recognizing the gap between two fiber bales. In this embodiment, on the bale transport carriage 22 an insertion station 109 is provided which, upon moving the fiber bale 1*n*' to the fiber bale 1*n*, inserts a marking plate 108 having preferably a point oriented towards the front face of the fiber bale 1*n*'. The marking plate 108 is held in position by virtue of the pressing engagement of the fiber bale 1*n*' against the fiber bale 1*n*. A receiving and recognizing station situated in the zone of the end roller 106 of the transport track 80 inductively senses the sheet metal plate member 108 and removes the same while the gap 103 is formed between the bales 1*a*' and 1*a*.

Figure 12:
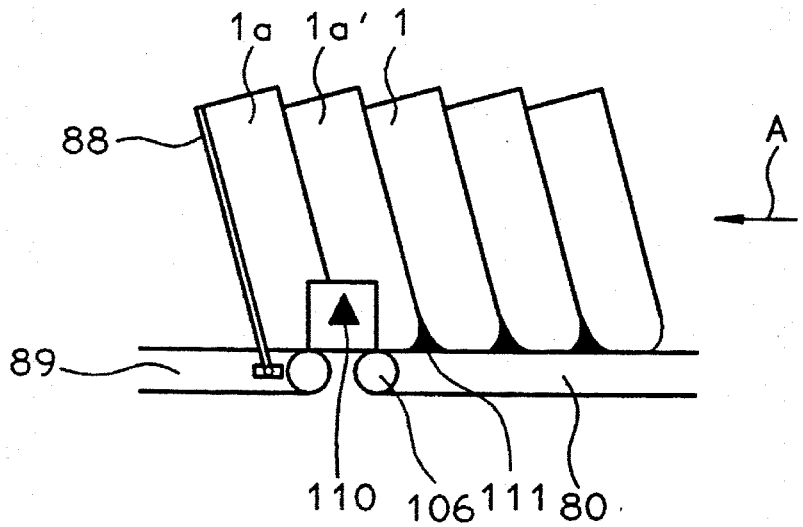

FIG. 12 illustrates an alternative embodiment to that shown in FIG. 11. Instead of the marking sheet metal plate members 108, wedges 111 are positioned on the transport track 80 by means of an inserting station 109 and are, by means of the bale 1*n*' pushed onto the bale in and thus mark the separating zone between the individual bales. The removal and recognizing station 110 may, if the wedges are of metal, operate inductively. The recognition, however, may be effected by ultrasound or may be a reflection-type optical barrier.

It will be understood that the above description of the present invention is susceptible to various modifications, changes and adaptations, and the same are intended to be comprehended within the meaning and range of equivalents of the appended claims.

What is claimed is:

1. A method of placing fiber bales end-to-end to form a substantially horizontally extending, longitudinal bale series in preparation for removing fiber tufts from the bales by a travelling bale opener; the bales of the series each having opposite lateral faces extending parallel to the length of the series and opposite end faces extending perpendicularly to the length of the series, comprising the following consecutive steps:

(a) depositing an initial fiber bale at an angle of inclination to the vertical;

(b) moving a bale holding device horizontally toward and into engagement with the opposite lateral faces of the initial fiber bale for stabilizing the initial fiber bale in the inclined position thereof;

(c) depositing at least one additional fiber bale next to and in engagement with the initial fiber bale such that the initial and additional fiber bales form the bale series; and (d) moving the bale holding device horizontally out of engagement with the opposite lateral faces of the initial fiber bale.

2. The method as defined in claim 1, wherein step (c) comprises the step of depositing said at least one additional fiber bale at an angle of inclination greater than the angle of inclination of said initial bale as viewed codirectionally with the angle of inclination of the initial bale; the angle of inclination of the additional bale being at least 90° to the horizontal.

3. A method of placing fiber bales into readiness for removing fiber tufts therefrom by a travelling bale opener, comprising the following cyclical steps:

(a) positioning fiber bales at an inclination and in a series on a transport track having a discharge end; each fiber bale of the series having opposite lateral faces extending parallel to the length of the series and opposite end faces extending perpendicularly to the length of the series;

(b) moving a bale holding device, situated at said discharge end, toward and into engagement with the opposite lateral faces of a leading fiber bale of the series for stabilizing the leading fiber bale in the inclined position thereof;

(c) moving a transfer carriage to said discharge end; said transport carriage having a support wall;

(d) moving the support wall towards and into engagement with one of the end faces of the leading fiber bale;

(e) moving the bale holding device out of engagement with the opposite lateral faces of the leading fiber bale;

(f) simultaneously and unidirectionally moving the transport track and the support wall, whereby the fiber bale series is displaced toward the transfer carriage, the leading bale of the fiber bale series is placed on the transfer carriage and a new leading bale is placed in alignment with the bale holding device;

(g) moving the bale holding device toward and into engagement with the opposite lateral faces of the new leading fiber bale;

(h) moving the transfer carriage with the leading fiber bale to an intake end of a conveyor belt; and (i) transferring the leading fiber bale from the transfer carriage onto the conveyor belt.

4. The method as defined in claim 3, further comprising the steps of generating a signal when a fiber bale of the series reaches said discharge end and discontinuing moving of the transport track by said signal.

5. The method as defined in claim 4, further comprising the step of sensing a gap between bottom faces of successive fiber bales of the series for generating said signal.

6. The method as defined in claim 4, further comprising the step of sensing a vertical drop of each fiber bale upon movement thereof from the transport track to the transfer carriage for generating said signal.

7. The method as defined in claim 4, further comprising the steps of providing each fiber bale with a marking prior to step (a) and sensing said marking for emitting said signal.

8. The method as defined in claim 7, wherein said step of providing each fiber bale with a marking comprises the step of applying paint.

9. The method as defined in claim 7, wherein said step of providing each fiber bale with a marking comprises the step of inserting a marking member.

10. The method as defined in claim 9, further comprising the step of removing the marking member after the sensing step.

11. A method of placing fiber bales into readiness for removing fiber tufts therefrom by a travelling bale opener, comprising the following cyclical steps:

(a) placing a fiber bale at an inclined position on a transfer carriage;

(b) supporting the fiber bale on the transfer carriage at said inclination by a support wall of the transfer carriage, engaging an end face of the bale;

(c) moving the transfer carriage with the fiber bale to an inlet end of a conveyor belt;

(d) transferring the fiber bale from the transfer carriage onto the inlet end of the conveyor belt while stabilized by the support wall and simultaneously moving the conveyor belt for conveying a previously deposited fiber bale away from the inlet end;

(e) moving a bale holding device, situated at said inlet end, toward and into engagement with opposite lateral vertical faces of the fiber bale for stabilizing the fiber bale at the inlet end and any adjoining fiber bale in the inclined position; and (f) moving the transfer carriage away from the conveyor belt.

12. The method as defined in claim 11, further comprising the step of depositing, in successive steps (d), a first plurality of bales at an angle of inclination to the vertical, pointing in the direction of motion of the conveyor belt and depositing, in successive steps (d), a second plurality of bales at an angle of inclination to the vertical, pointing away from the direction of motion of the conveyor belt; the last-deposited bale of the first plurality leaning against the first-deposited bale of the second plurality, and discontinuing step (e) when opposing forces derived from the first and second plurality are in equilibrium.

13. An apparatus for placing fiber bales end-to-end in a series, comprising (a) bale emplacement means for supporting the bales forming the series; said bale emplacement means having a length dimension;

(b) bale depositing means for sequentially setting fiber bales at an inclination on the bale emplacement means to build said series along said length dimension; and (c) a bale holding device situated at a location along said bale emplacement means; said bale holding device having (1) a bale engaging member movable into engagement with a vertical lateral face of a bale situated at said location for stabilizing the bale; and (2) power means for moving said bale engaging member transversely to said length dimension along a path into or out of engagement with the bale situated at said location.

14. An apparatus as defined in claim 13, wherein said bale depositing device comprises a carriage; a conveyor belt mounted on said carriage for moving a bale onto and off the carriage; and an inclined support wall mounted on the carriage and movable in unison with said conveyor belt; said support wall being adapted to engage an end face of the bale standing on said conveyor belt.

15. The apparatus as defined in claim 13, wherein said bale engaging member comprises two spike boards positioned on opposite sides of said bale emplacement means and provided with spikes; and wherein said power means comprises means for moving said spike boards simultaneously toward one another for causing said spikes to simultaneously penetrate into opposite vertical lateral faces of the fiber bale.

16. The apparatus as defined in claim 13, wherein said bale engaging member comprises a pressure plate and a spike board having spikes; said pressure plate and said spike board being positioned on opposite sides of said bale emplacement means; further wherein said power means comprises means for moving said pressure plate and said spike board simultaneously toward one another for causing said spikes to penetrate into a first lateral vertical face of the bale and for simultaneously causing said pressure plate to be pressed against a second, opposite lateral vertical face of the bale.

17. The apparatus as defined in claim 13, wherein said path is oriented horizontally to said length dimension of said bale emplacement means.

18. The apparatus as defined in claim 13, wherein said power means comprises a power cylinder.

19. An apparatus for placing fiber bales end-to-end in a series in preparation for fiber tuft removal by a travelling bale opener, comprising (a) a first conveyor belt having a discharge end;

(b) a first carriage movable along the first conveyor belt for sequentially depositing fiber bales at an inclination on the first conveyor belt in an end-to-end contacting relationship to form a first bale series on and along said first conveyor belt;

(c) a first bale holding device situated at said discharge end of said first conveyor belt; said first bale holding device having (1) a bale engaging member movable into engagement with a vertical lateral face of a bale situated at said discharge end for stabilizing the bale; and (2) power means for moving said bale engaging member into or out of engagement with the bale situated at said discharge end;

(d) a second conveyor belt having an intake end spaced from the discharge end of said first conveyor belt;

(e) a second carriage movable back-and-forth between said discharge end of said first conveyor belt and said intake end of said second conveyor belt for sequentially transferring a fiber bale from said discharge end of said first conveyor belt to said intake end of said second conveyor belt; and (f) a second bale holding device situated at said intake end of said second conveyor belt; said second bale holding device having (1) a bale engaging member movable into engagement with a vertical lateral face of a bale situated at said intake end for stabilizing the bale; and (2) power means for moving said bale engaging member of said second bale holding device into or out of engagement with the bale situated at said intake end of said second bale conveyor.

20. An apparatus for placing fiber bales into readiness for removing fiber tufts therefrom by a travelling bale opener, the apparatus comprising (a) means for placing fiber bales in an inclined position and in a series on a transport track having a discharge end; each fiber bale of the series having opposite lateral faces extending parallel to the length of the series and opposite end faces extending perpendicularly to the length of the series;

(b) means for moving a bale holding device, situated at said discharge end, toward and into engagement with the opposite lateral faces of a leading fiber bale of the series for stabilizing the leading fiber bale in the inclined position thereof;

(c) means for moving a transfer carriage to said discharge end; said transport carriage having a support wall;

(d) means for moving the support wall towards and into engagement with one of the end faces of the leading fiber bale;

(e) means for moving the bale holding device out of engagement with the opposite lateral faces of the leading fiber bale;

(f) means for simultaneously and unidirectionally moving the transport track and the support wall, whereby the fiber bale series is displaced toward the transfer carriage, the leading bale of the fiber bale series is placed on the transfer carriage and a new leading bale is placed in alignment with the bale holding device;

(g) means for moving the bale holding device toward and into engagement with the opposite lateral faces of the new leading fiber bale;

(h) means for moving the transfer carriage with the leading fiber bale to an intake end of a conveyor belt; and (i) means for transferring the leading fiber bale from the transfer carriage onto the conveyor belt.

21. An apparatus for placing fiber bales into readiness for removing fiber tufts therefrom by a travelling bale opener, the apparatus comprising (a) means for positioning a fiber bale at an inclination on a transfer carriage;

(b) means for supporting the fiber bale on the transfer carriage at said inclination by a support wall of the transfer carriage, engaging an end face of the bale;

(c) means for moving the transfer carriage with the fiber bale to an inlet end of a conveyor belt;

(d) means for transferring the fiber bale from the transfer carriage onto the inlet end of the conveyor belt while stabilized by the support wall and for simultaneously moving the conveyor belt for conveying a previously deposited fiber bale away from the inlet end;

(e) means for moving a bale holding device, situated at said inlet end, toward and into engagement with opposite lateral vertical faces of the fiber bale for stabilizing the fiber bale at the inlet end and any adjoining fiber bale in the inclined position; and (f) means for moving the transfer carriage away from the conveyor belt.

* * * * *